US008720235B2

(12) United States Patent
Geyer et al.

(10) Patent No.: US 8,720,235 B2
(45) Date of Patent: May 13, 2014

(54) LAUNDRY DRUM FOR A LAUNDRY TREATING MACHINE

(75) Inventors: Johannes Geyer, Haar (DE); Stephan Sommer, Falkensee (DE); Max Speckhart, Fridolfing (DE); Roland Vetter, Giengen (DE); Wilfried Wildung, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 898 days.

(21) Appl. No.: 12/863,789

(22) PCT Filed: Jan. 20, 2009

(86) PCT No.: PCT/EP2009/050599

§ 371 (c)(1),
(2), (4) Date: Jul. 21, 2010

(87) PCT Pub. No.: WO2009/095334

PCT Pub. Date: Aug. 6, 2009

(65) Prior Publication Data

US 2010/0287996 A1 Nov. 18, 2010

(30) Foreign Application Priority Data

Jan. 29, 2008 (DE) ..... 10 2008 006 511

(51) Int. Cl.

| | |
|---|---|
| ***D06F 21/00*** | (2006.01) |
| ***D06F 23/00*** | (2006.01) |
| ***D06F 25/00*** | (2006.01) |

(52) U.S. Cl.
USPC ..... 68/142; 68/139; 68/144

(58) Field of Classification Search
USPC ..... 68/139
See application file for complete search history.

(56) References Cited

U.S. PATENT DOCUMENTS

| | | | | |
|---|---|---|---|---|
| 2003/0167804 | A1* | 9/2003 | Yoon | 68/232 |
| 2004/0123634 | A1 | 7/2004 | Kim et al. | |
| 2005/0103060 | A1 | 5/2005 | Ozturk et al. | |
| 2007/0295035 | A1* | 12/2007 | Lim | 68/3 R |
| 2008/0229516 | A1 | 9/2008 | Hashimoto | |

FOREIGN PATENT DOCUMENTS

| | | |
|---|---|---|
| DE | 1805126 | 2/1960 |
| DE | 1290909 B | 3/1969 |
| DE | 4437986 A1 | 4/1996 |
| DE | 19952990 A1 | 5/2001 |
| DE | 10-2006-041431 | 6/2007 |
| EP | 1028189 A3 | 8/2001 |

* cited by examiner

*Primary Examiner* — Michael Barr
*Assistant Examiner* — Levon J Shahinian
(74) *Attorney, Agent, or Firm* — Nixon & Vanderhye P.C.

(57) ABSTRACT

A laundry drum for a laundry treating machine, wherein the laundry drum includes a drum cover that has a cylindrical shape and structures that are distributed in a circumferential direction of the drum cover. The structures project from the cylindrical shape of the drum cover that is mounted in the laundry drum. Further, the structures are formed from inwardly bulging linear elevations that extend along a circumferential line.

32 Claims, 6 Drawing Sheets

LAUNDRY DRUM FOR A LAUNDRY TREATING MACHINE

This application is U.S. National Phase of International Application No. PCT/EP2009/050599, filed on Jan. 20, 2009 and claims priority to German Patent Application No. 102008006511.0, filed on Jan. 29, 2008, the entire contents of each which are hereby incorporated by reference.

BACKGROUND OF THE INVENTION

The invention relates to a laundry drum for a laundry treating machine, having a drum cover which has structures distributed in the circumferential direction, which project from the cylindrical shape of the drum cover mounted in the laundry drum.

Such a laundry drum is known from DE 44 37 986 A1, wherein are shown in particular structures in the cover sheet of a laundry drum in the form of quadrangular or hexagonal arched surfaces offset with respect to one another. Such structures have been used in the case of laundry drums primarily because on the one hand they give the structured cover sheet a certain dimensional stability, the effect of which in particular is a diminished tendency for acoustic oscillation. On the other hand, such a structure however also has a certain decorative effect. By contrast, it has not been possible to demonstrate a once supposed advantageous influence on the mechanical treatment of the laundry.

BRIEF SUMMARY OF THE INVENTION

The object of the invention is to find a cover sheet structure for a laundry drum described in the introduction, which on the one hand has the advantageous properties of structures of the prior art, but which also creates the fundamentals for their design in order to advantageously influence the mechanical treatment of the laundry during the rotary motion of the drum.

This object is achieved according to the invention in such a manner that the structures are formed from inwardly bulging linear elevations extending along the circumferential line. This is because such elevations can—as will be described in the following—in many respects be designed such that they have an advantageous influence on the mechanical treatment of the laundry while the drum is rotating. Since they moreover stabilize the drum cover to the extent that the material usage for the drum sheet can be reduced to a minimum, that no tendency towards acoustic oscillations is to be feared and that the surface properties of a cover surface formed in such a manner are almost ideal for the treatment of the laundry, a laundry drum designed according to the invention will represent an optimum for use in the treatment of laundry.

The elevations can thus follow straight lines which extend at least partially parallel or non-parallel to one another and/or to the circumferential direction of the drum. The linear elevations can be closed or interrupted in the circumferential direction. They can be spaced equally or unequally from one another and be of equal width or at least partially unequal width or of different widths. They can follow wavy lines, sine waves for example, zigzag lines or helical lines and when viewed with reference to the axial direction of the drum can be in phase or out of phase with respect to one another. In the case of a laundry drum having flood holes in the drum cover, at least a portion of the flood holes can be included in either one or in both faces of the elevations. Other flood holes can be placed in those areas of the drum cover which are situated outside the elevations.

BRIEF DESCRIPTION OF THE DRAWINGS

The invention will be described in detail with reference to exemplary embodiments represented in the drawing. In the drawings.

DETAILED DESCRIPTION OF EXEMLARY EMBODIMENTS OF THE PRESENT INVENTION

Figure 1:
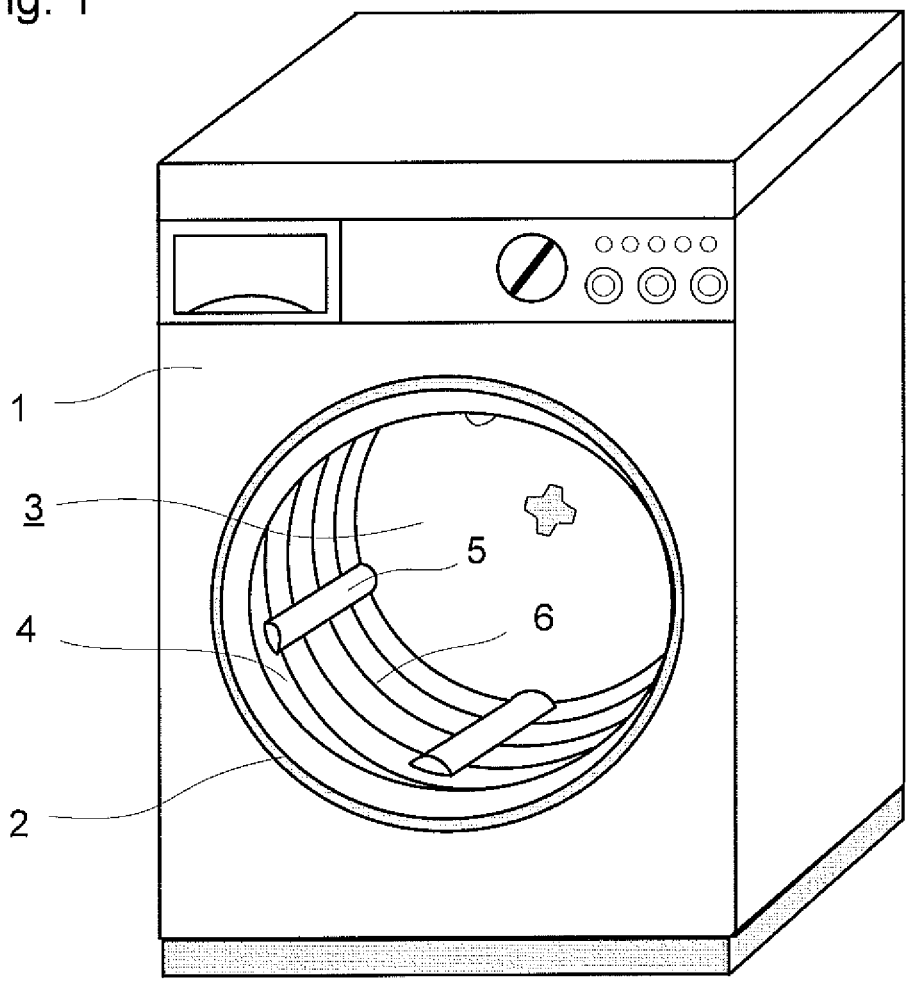
FIG. 1 shows a perspective view of the front side of a laundry treating machine, with a free view into the laundry drum, the cover sheet of which is provided with linear elevations on the inside.

Illustrated as a laundry treating machine in FIG. 1 is a washing machine, the charging opening 2 of which, located on the front side 1 with the door removed, affords a view into the interior of the laundry drum 3. Said machine has a cylindrical drum cover 4, on the inside of which are evenly distributed a plurality of laundry agitator paddles 5. In addition, the drum cover 4 has inwardly bulging linear elevations 6 which will be described in further detail with reference to the following figures. These elevations mean on the one hand that the drum cover becomes a mechanically vibration-resistant entity and that as a result acoustic disturbances which could otherwise be expected remain absent. On the other hand, as a result of the considerable increase in rigidity material can be saved with regard to reduced wall thicknesses for the drum cover 4 and—as will be also be shown further below—a surface configuration which is especially gentle on laundry can be achieved, which nevertheless produces an enhanced mechanical washing effect.

Figure 2:
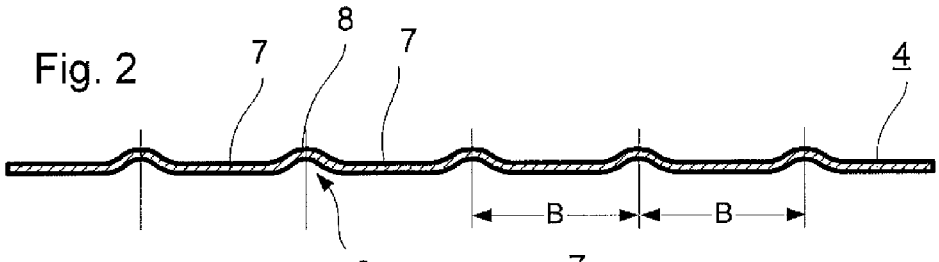
FIG. 2 shows a cross-section through a cover sheet parallel to the axial direction of the laundry drum having linear elevations.
Figure 3:
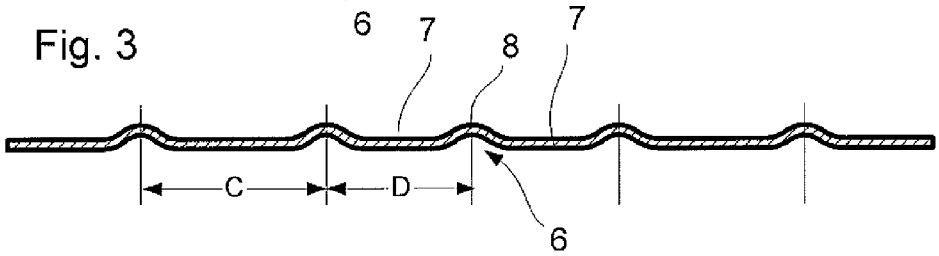
FIG. 3 shows a cross-section as in FIG. 2 having different spacings for the linear elevations.

For example, linear elevations 6 in accordance with FIG. 1 can assume a form illustrated in FIG. 2 or 3, when viewing the cross-section of the sheet metal of such a drum cover 4. In this situation, the elevation 6 gradually swings inwards out of the cylindrical shape of the region 7 of the drum cover 4, forms a smooth ridge line 8 and swings equally smoothly back into the cylindrical shape of the region 7. The regions 7 remaining in the cylindrical shape can—as illustrated—remain closed in the case of a laundry treating machine which requires no exchange of liquids for the treatment process.

In a laundry treating machine which exchanges liquids between the laundry, the drum interior and the space surrounding the laundry drum for the treatment process—for example in a washing machine—so-called flood holes can be included in the cylindrical regions. Such flood holes are well-known, but are not shown in FIGS. 1 to 3 for reasons of clarity.

In this situation, the spacings B of the elevations 6 in FIG. 2 are of equal size to one another, in contrast to the elevations 6 in FIG. 3, the spacings C and D of which are not equal. This can play a part in such treatment processes where the laundry distributes itself non-uniformly inside the drum while the latter is rotating.

In the following figures the fragments of drum casings 4 are represented as essentially flat planar bodies which can be refashioned into a laundry drum by forming into a cylinder. Deviating from the examples in FIGS. 2 and 3, the elevations 6 also do not swing inwards and upwards gradually from the cylindrical regions 7; this is because they are delimited from the regions 7 by means of a relatively sharp bending edge 9. The elevations 6 or their arrangement with respect to one another differ on the one hand from those in FIGS. 2 and 3 but on the other hand also from exemplary embodiment to exemplary embodiment amongst themselves.

Figure 4:
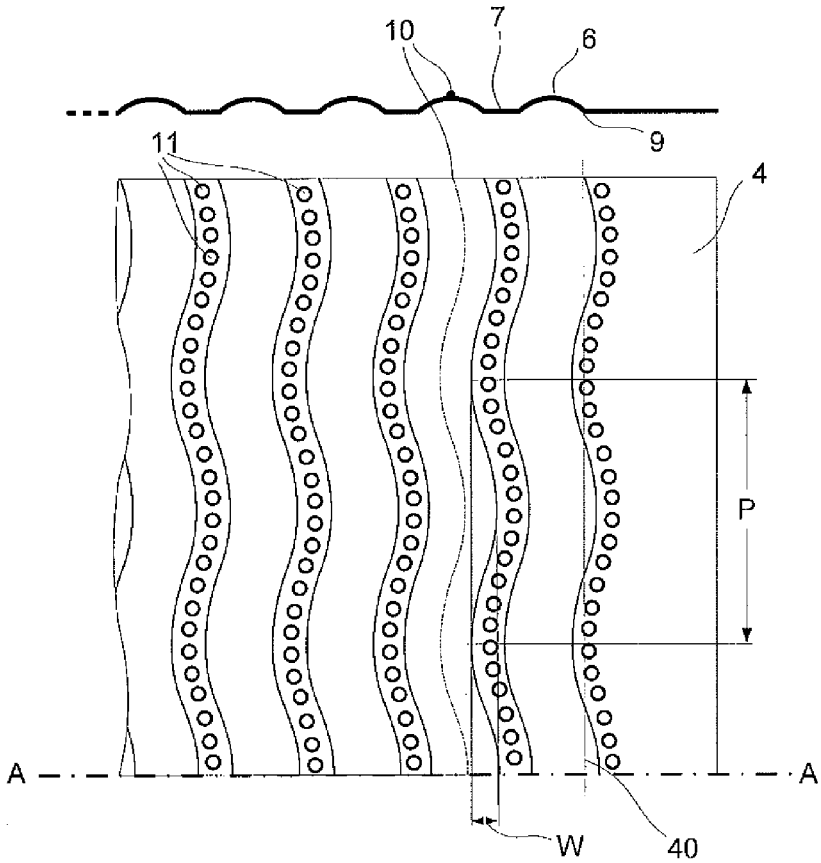
FIG. 4 shows the view from outside of a cover sheet having in-phase wave-like elevations and a cross-section through such a cover sheet parallel to the axial direction A-A of the laundry drum.

FIG. 4 thus shows a drum cover 4 on the inside of which linear elevations 6 bulge up and embrace the drum cover along the circumferential line 40 in a closed loop. In this situation, the ridge lines 10 of the elevations follow a sinusoidal oscillation having a phase length P and a peak-to-valley value W. Phase length P and peak-to-valley value W can be varied as required and by experimentation, taking into consideration the mechanical washing effect. The regions 7 of the drum cover each contain a series of flood holes 11. Provided that the laundry drum thus equipped is not intended for a liquid-conducting laundry treating machine, the flood holes 11 can be dispensed with. This applies equally to the drum covers described in the following.

Figure 5:
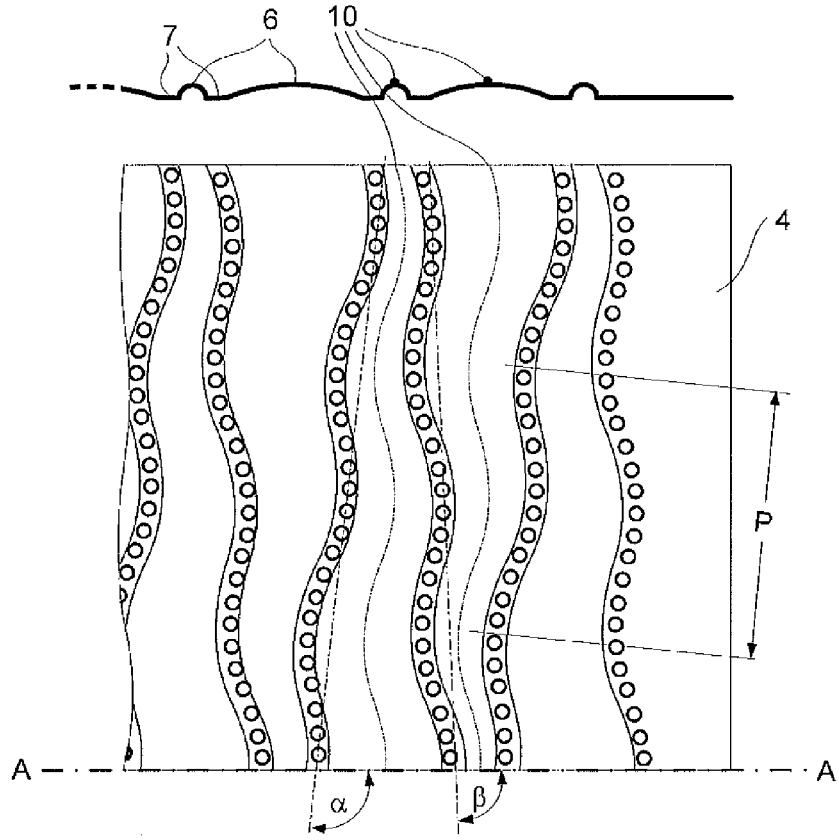
FIG. 5 shows an exterior view and cross-section corresponding to FIG. 4 having non-parallel wave-like elevations of different widths.

The drum cover 4 illustrated in FIG. 5 likewise has linear elevations 6. Adjacent regions 7 between the elevations do not however run parallel to one another. Their principal axes are at an angle $\alpha \approx 100°$ or $\beta \approx 80°$ to the drum axis A-A, which deviates from the right angle. Phase length P and peak-to-valley value W are similar in this example to those in FIG. 4. Before the regions 7 come into contact with each other, they can reverse their angular position $\alpha$ or $\beta$ and thus again narrow in their further course the elevations 6 which have the greatest width and height at the position of the closest proximity of respectively adjacent regions 7. Instead, the elevations 6 can however simply be restricted in their length and the regions 7 thereby be connected between the restrictions. The angular positions of the principal axes of the regions 7 can—as can naturally also the phase lengths and peak-to-valley values—be varied as required and by experimentation.

Figure 6:
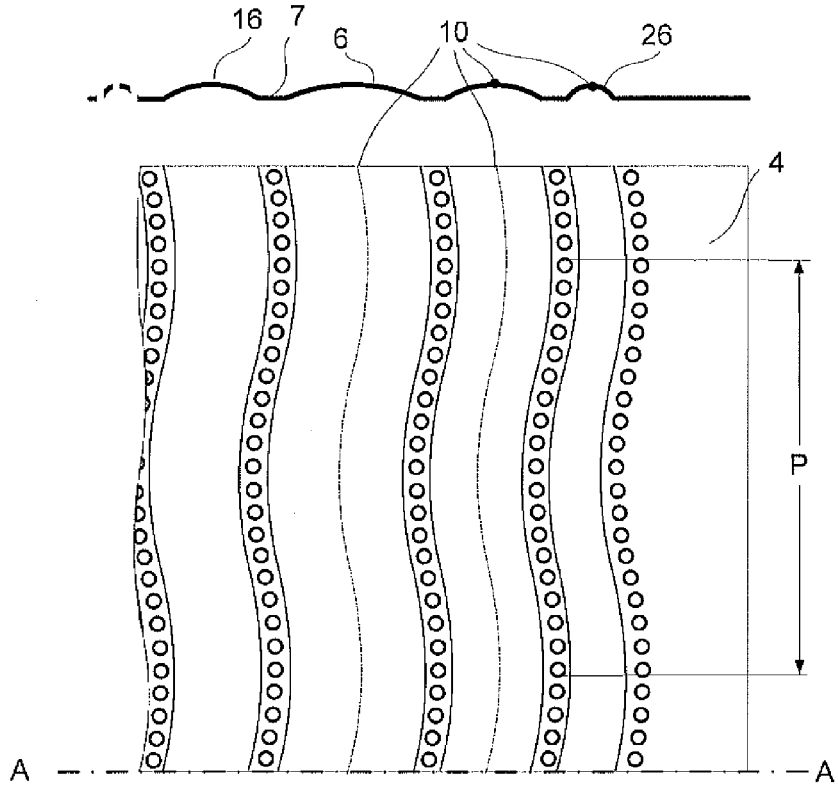
FIG. 6 shows an exterior view and cross-section corresponding to FIG. 4 having parallel and in-phase but unequally wide wave-like elevations.

The drum cover 4 in FIG. 6 is extremely similar to that shown in FIG. 4. Here, the phase lengths of the elevations 6, 16 and 26 are greater than in FIG. 4. Furthermore, the regions 7 located parallel to one another have different spacings B, C and D, with the result that the elevations 6, 16 and 26 situated between them have different widths. The elevations 6, 16 and 26 have almost the same heights amongst themselves, with the result that the elevation 6 is perceived to be flatter than the elevations 16 and 26, but the curvature of its bulging is merely less. The same variations are possible here as in the preceding examples and in the following examples. These also include variations in the heights of the elevations 6 or 16 and 26.

Figure 7:
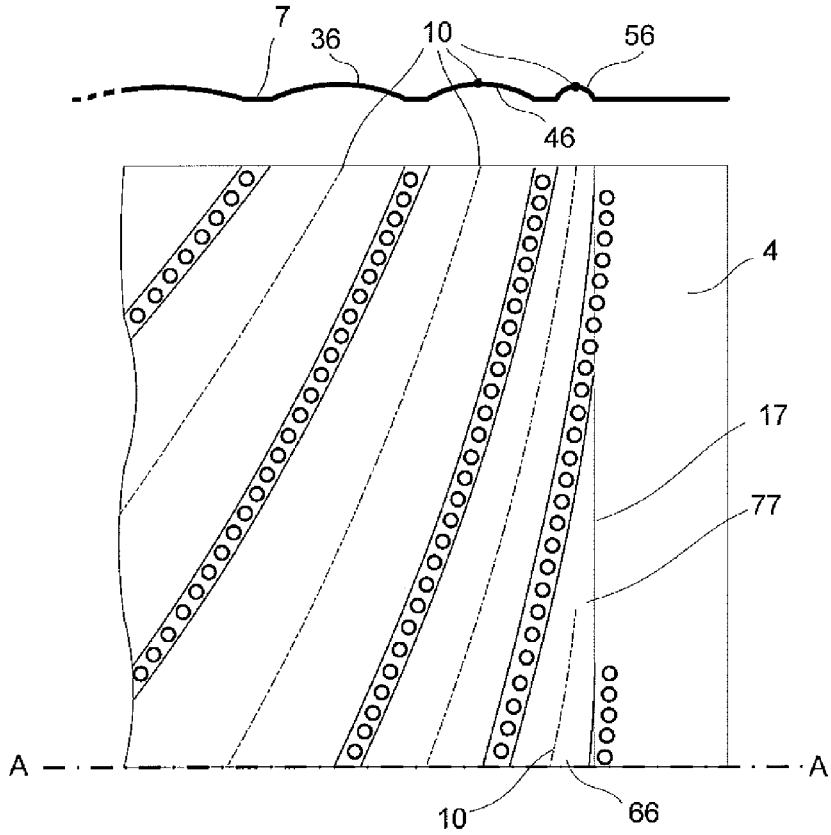
FIG. 7 shows an exterior view and cross-section corresponding to FIG. 4 having curved, helically arranged elevations of different widths.

By contrast, the elevations 36, 46 and 56 in FIG. 7 follow a quite different regime. As can be seen in region 77, an elevation 66 rises gradually from the edge line 17 and follows a helix with its ridge line 10. In this manner, the ridge lines of all the elevations 36, 46, 56 and 66 splay ever further apart and the elevations 36, 46, 56 and 66 widen until they steeply strike and terminate at the other edge of the drum cover 4. This exemplary embodiment is likely to be of interest in particular in such laundry treating machines as those in which movements of the laundry along the axis of rotation of the laundry drum are to be supported through control of the direction of drum rotation.

Figure 8:
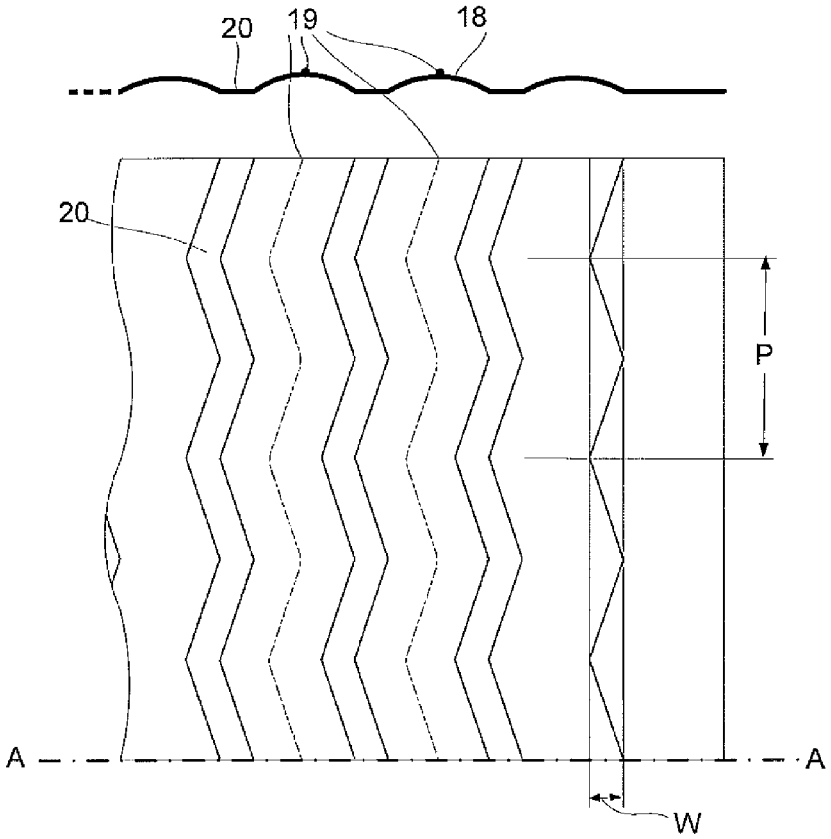
FIG. 8 shows an exterior view and cross-section corresponding to FIG. 4 having in-phase elevations of equal width arranged parallel to one another in zigzag lines.

With regard to an exemplary embodiment shown in FIG. 8, the elevations 18 have phases P of approximately the same length as the sinusoidal elevations 6 shown in FIG. 4. The peak-to-valley value W is somewhat greater. The elevations 18 in question are delimited by zigzag shaped cylindrical regions 7 of the drum cover 4 with regard to this type of elevation 18, the ridge lines 19 of which likewise follow an almost zigzag line. The sharp corners of a zigzag line are however rounded. The cylindrical regions 20 have no flood holes here. In the case of use of a liquid alternating between the inner space and the outer space of the drum, flood holes would however be added in these regions 20.

Figure 9:
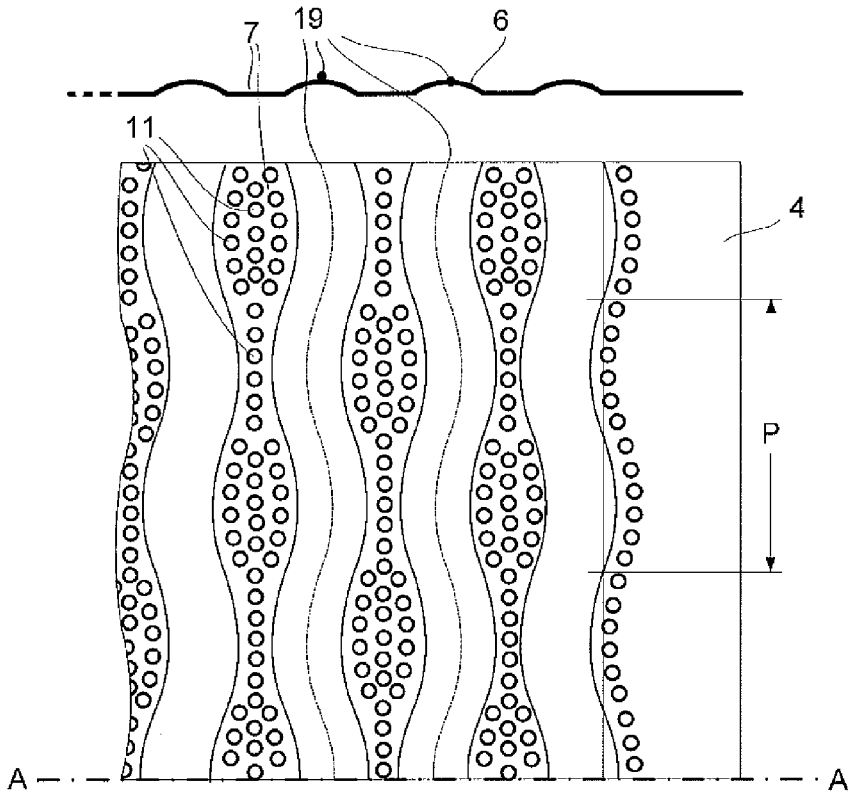
FIG. 9 shows an exterior view and cross-section corresponding to FIG. 4 having wave-like elevations arranged in phase opposition and parallel to one another.
Figure 11:
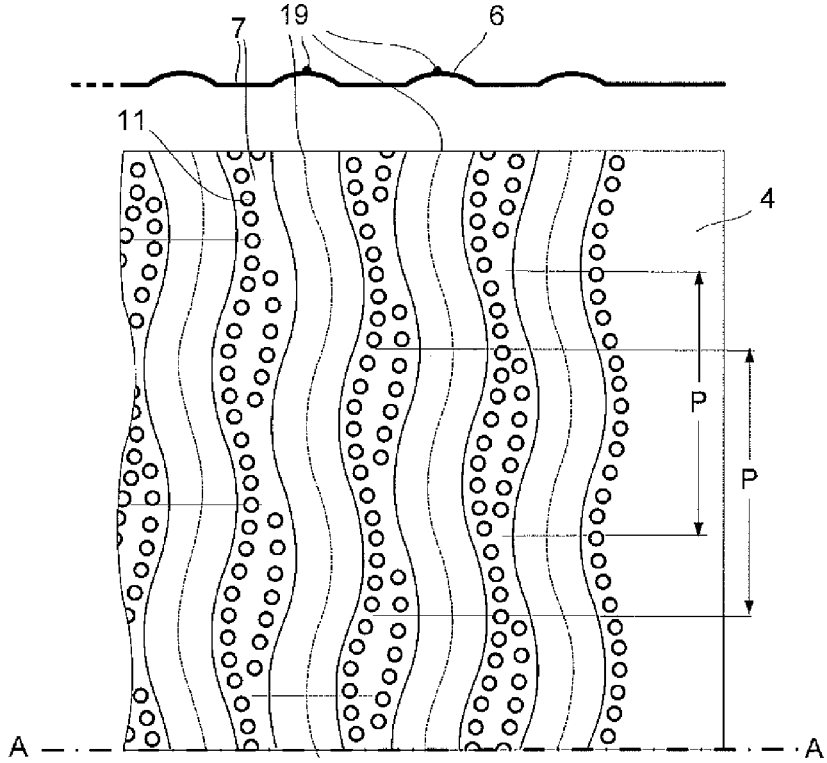
FIG. 11 shows an exterior view and cross-section corresponding to FIG. 4 having wave-like elevations arranged parallel to one another but offset with respect to each other.

The drum cover in accordance with FIG. 9 similarly has sinusoidal elevations 6 like those in FIG. 4. The phase positions of adjacent elevations 6 do however vary, with the result that the cylindrical regions 7 situated between them have narrow and broad regions shaped in the same sinusoidal form, which are equipped with more or fewer flood holes 11 per circumferential line segment. This consequence could be decisive in the choice of the variants. The phase shift between the elevations 6 does not need—as shown here—to be chosen as half a phase length. In the case of a smaller or greater phase shift, cylindrical regions 7 are produced which indeed likewise become narrower and broader along the circumferential line. They do then however likewise contain curved regions which are linear over an extended length and offer space for one only series of flood holes. The broader regions are by contrast narrower than in FIG. 9. Such a variant is shown in FIG. 11.

Figure 10:
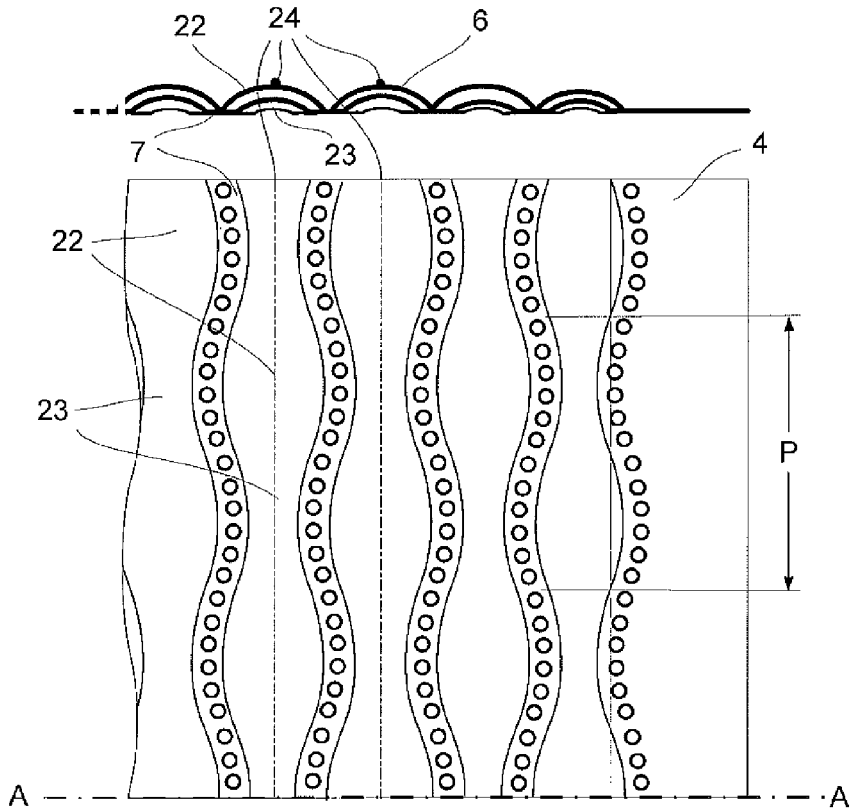
FIG. 10 shows an exterior view and cross-section corresponding to FIG. 4 having elevations arranged parallel and in phase opposition to one another with wave-like varied width.

With regard to the exemplary embodiment shown in FIG. 10, the conditions are reversed compared with the example from FIG. 9. Here, the cylindrical regions 7 oscillate in phase opposition while the elevations 6 become narrow and broader along the circumferential line. Accordingly, with the curvature of the elevations 6 along the circumferential line remaining the same the bulges 22 and 23 are sometimes higher and sometimes lower, with the result that alternately high and low bulges 22 and 23 are produced which exert a mechanical influence on the laundry in addition to the agitator paddles 5 arranged in the drum (FIG. 1) while the drum is rotating.

Figure 12:
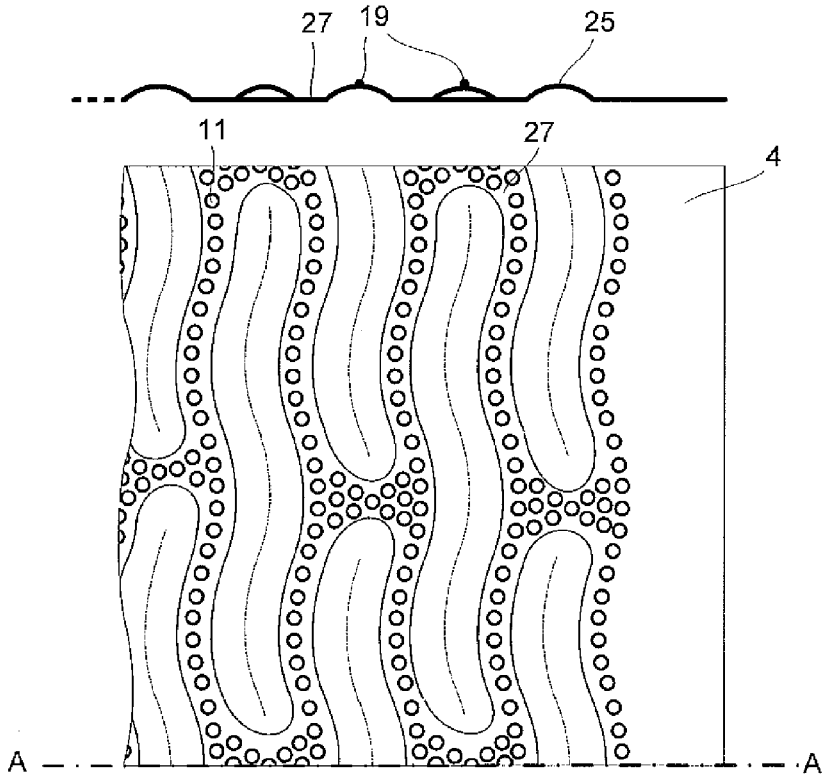
FIG. 12 shows an exterior view and cross-section corresponding to FIG. 4 having wave-like elevation sections, each of limited length, arranged parallel to and in phase with each other, which are arranged offset with respect to each other.

FIG. 12 also demonstrates how a drum cover 4 having finite elevations 25 may appear, with the result that each elevation 25 is surrounded by a cylindrical region 27. This means that it is possible to add a greater number of flood holes 11 in order that a more intensive exchange of liquids can take place. The frequently alternating contact with the laundry with different bulges of the elevations 25 furthermore increases the mechanical washing effect.

In variance from the exemplary embodiments illustrated, the flood holes 11 arranged regularly in the cylindrical regions 7 can be either additionally or exclusively added in such faces of elevations 6, 16, 18, 25, 26, 36, 46, 56 or 66 as oppose the liquid flooding in the laundry drum while it is rotating. For example, the faces of the elevations 36, 46, 56, and 66 from FIG. 7 are best suited for this purpose because they have partial regions which stand almost crosswise to the moved liquid. But also those parts of the elevations in the other figures, which have at least not too small an oblique angle with respect to the movement of liquid—this will normally be the movement in the circumferential direction—can have flood holes 11 in these parts of their faces.

The invention claimed is:

1. A laundry drum for a laundry treating machine, the laundry drum comprising:

a drum cover having a cylindrical shape and a plurality of structures distributed in a circumferential direction of the drum cover;

wherein the plurality of structures projects from the cylindrical shape of the drum cover mounted in the laundry drum; and wherein the plurality of structures are formed from inwardly bulging elevations elongated in the circumferential direction and extending along an inner circumference of the drum cover, wherein the elevations have at least a portion that is angled relative to the circumferential direction, to influence mechanical treatment of laundry during rotation of the drum.

2. The laundry drum of 1, wherein the elevations are straight.

3. The laundry drum of claim 2, wherein the elevations extend generally parallel to the circumferential direction.

4. The laundry drum of claim 2, wherein the elevations are closed in the circumferential direction.

5. The laundry drum of claim 2, wherein at least one of the elevations has respective spacings from adjacent elevations that differ at least partially from one another.

6. The laundry drum of claim 1, wherein the linear elevations extend non-parallel to the circumferential direction and non-parallel to an axial direction of the drum cover at least over part of the length of the elevations.

7. The laundry drum of claim 6, wherein the elevations have principal axes angled at ±10° from a longitudinal axis of the drum.

8. The laundry drum of claim 1, wherein the elevations extend in helical form in the circumferential direction.

9. The laundry drum of claim 1, wherein the elevations, as seen in plan view, have substantially zigzag shapes.

10. The laundry drum of claim 9, wherein an amplitude of the substantially zigzag shape is in the same order of magnitude as a period of the substantially zigzag shape.

11. The laundry drum of claim 1, wherein the elevations, as seen in plan view, follow a wave form.

12. The laundry drum of claim 11, wherein the wave form, as seen in plan view, is substantially similar to a sine wave.

13. The laundry drum of claim 11, wherein an amplitude of the wave form is in the same order of magnitude as a period of the wave form.

14. The laundry drum of claim 1, wherein adjacent ones of the elevations extend parallel in the circumferential direction when viewed in an axial direction of the laundry drum.

15. The laundry drum of claim 1, wherein adjacent ones to the elevations extend in opposite directions in the circumferential direction.

16. The laundry drum of claim 1, wherein adjacent ones of the elevations extend in the circumferential direction and are offset to each other in an axial direction of the laundry drum.

17. The laundry drum of claim 1, wherein at least one of the elevations has at least partially different spacings with respect to an adjacent elevation.

18. The laundry drum of claim 1, wherein the elevations have finite lengths, and wherein adjacent ones of the elevations are offset with respect to each other in the circumferential direction.

19. The laundry drum of claim 1, wherein the elevations are at least partially of different widths along their longitudinal axes.

20. The laundry drum of claim 1, wherein the drum cover has flood holes; and wherein at least a portion of the flood holes is included in one of one and both faces on the elevations.

21. The laundry drum of claim 1, wherein each of the elevations includes a ridge line defining a peak of the elevation.

22. The laundry drum of claim 1, wherein at least a portion of adjacent elevations do not run parallel to one another.

23. The laundry drum of claim 1, further comprising a plurality of agitators extending into the drum, the elevations running substantially transverse to the agitators.

24. A laundry drum of claim 1, wherein the elevations have a rounded profile as seen in cross section taken across a longitudinal axis of the elevations, each rounded profile including a peak located at a center portion of the elevation, as seen in said second cross section.

25. A laundry drum for a laundry treating machine, the laundry drum comprising:

a drum cover having a cylindrical shape and at least one elongated elevation extending in a substantially circumferential direction of the drum cover;

wherein the at least one elevation projects inwardly from the cylindrical shape of the drum cover mounted in the laundry drum; and wherein the at least one elevation extends along an inner circumference of the drum cover, the elevation having at least one portion that is angled relative to the circumferential direction, to influence mechanical treatment of laundry during rotation of the drum.

26. The laundry drum of claim 25 wherein the elevation extends in a helical form in the substantially circumferential direction.

27. The laundry drum of claim 25, wherein the elevation, as seen in plan view, has a substantially zigzag shape.

28. The laundry drum of claim 25, wherein the linear elevation is at least partially of different widths along its longitudinal axis.

29. The laundry drum of claim 25, wherein the drum cover has flood holes; and wherein at least a portion of the flood holes is included in one or more faces on the elevation.

30. The laundry drum of claim 25, wherein the elevation includes a ridge line defining a peak of the elevation.

31. The laundry drum of claim 25, further comprising at least one agitator extending into the drum, the elevation running substantially transverse to the agitator.

32. A laundry drum of claim 25, wherein the elevation has a rounded profile as seen in cross section taken across a longitudinal axis of the elevation, a portion of the rounded profile being positioned at a center portion of the elevation.

* * * * *